US007516817B2

(12) United States Patent
Pate et al.

(10) Patent No.: US 7,516,817 B2
(45) Date of Patent: Apr. 14, 2009

(54) LADDER WITH KNEE BRACE AND METHOD

(75) Inventors: Jon M. Pate, Conneaut Lake, PA (US); Kevin L. McIntire, Stoneboro, PA (US)

(73) Assignee: Werner Co., Greenville, PA (US)

( * ) Notice: Subject to any disclaimer, the term of this patent is extended or adjusted under 35 U.S.C. 154(b) by 295 days.

(21) Appl. No.: 11/035,739

(22) Filed: Jan. 15, 2005

(65) Prior Publication Data

US 2005/0173194 A1 Aug. 11, 2005

Related U.S. Application Data

(60) Provisional application No. 60/538,956, filed on Jan. 23, 2004.

(51) Int. Cl.
*E06C 7/50* (2006.01)

(52) U.S. Cl. ..... 182/217; 182/219; 182/220; 248/351

(58) Field of Classification Search ..... 182/217, 182/219, 220; 248/351
See application file for complete search history.

(56) References Cited

U.S. PATENT DOCUMENTS 4,949,811 A * 8/1990 Bailey ..... 182/220
5,791,439 A * 8/1998 Plotner et al. ..... 182/219
2005/0051386 A1* 3/2005 Simpson ..... 182/217

* cited by examiner

*Primary Examiner*—Richard E Chilcot, Jr.
*Assistant Examiner*—Matthew J Smith
(74) *Attorney, Agent, or Firm*—Ansel M. Schwartz

(57) ABSTRACT

A knee brace for a ladder including a first flange and a second flange. The brace includes a web extending from the first flange and the second flange which together form a u-shaped cross-section. The brace includes a first portion that connects to a step. The brace includes a second portion which connects to the rail and terminates at a distance from a joint. The second portion's first and second flanges and web presenting three contact surfaces which connect to the rail and extend essentially in parallel with the rail and conforms with the rail to which the knee brace is attached so forces can be transferred therebetween. The first and second flanges contact a first rail flange and second rail flange, respectively, and the web contacts the web of the rail of u-shaped cross-section. The brace includes a first rivet extending through the first rail flange and first flange. The brace includes a second rivet extending through the second rail flange and the second flange adjacent the rail end. A method for using a ladder.

5 Claims, 15 Drawing Sheets

LADDER WITH KNEE BRACE AND METHOD

This application claims the benefit of U.S Provisional Application No. 60/538,956 filing date Jan. 23, 2004.

FIELD OF THE INVENTION

The present invention is related to a knee brace for a ladder that has a contact surface which conforms with a rail of the ladder. More specifically, the present invention is related to a knee brace for a ladder that has a contact surface which conforms with a rail of the ladder that has no buttressing and has rivets only through the flanges of the brace to hold the brace to the rail.

BACKGROUND OF THE INVENTION

Ladders experience horizontal as well as vertical forces while they are used. To better respond to the horizontal forces that may be experienced by the ladder, knee braces have been used to connect the bottom step or horizontal with a rail. The present invention is directed to an improved knee brace that has been combined with a rail support and preferably a foot to better respond to horizontal forces, and increase manufacturing efficiency. Furthermore, by placing the rivets through the flanges of the rail and the knee brace, it allows an automatic riveter to be used, which is already being applied to other sections of the ladder being assembled. This further increases the efficiency of manufacturing. However, just as important, or probably more important, by placing the rivets on the flange, the rails are strengthened against shear forces. When, for instance, the ladder is being unloaded from a vehicle, it sometimes happens that the end of a rail falls against the ground. When the rail end hits the ground, shear forces are created in the rail. By having the rivets in the flange where the rivets are perpendicularly oriented against the shear forces that arise in such circumstances, the rivets and thus the rail is better able to absorb such shear forces without suffering any damage. In addition, to increase material efficiency, buttressing in the brace, as described in U.S. Pat. No. 6,142,255, is eliminated.

SUMMARY OF THE INVENTION

The present invention pertains to a knee brace for a ladder having a rail with a first rail flange, second rail flange and a rail web disposed between the first rail flange and the second rail flange, a step connected to the rail to form a joint, and a rail end. The brace comprises a first flange. The brace comprises a second flange. The brace comprises a web extending from the first flange and the second flange which together form a u-shaped cross-section. The brace comprises a first portion that connects to the step. The brace comprises a second portion which connects to the rail and terminates at a distance from the joint. The second portion's first and second flanges and web presenting three contact surfaces which connect to the rail and extend essentially in parallel with the rail and conforms with the rail to which the knee brace is attached so forces can be transferred therebetween. The first and second flanges contact the first rail flange and second rail flange, respectively, and the web contacts the web of the rail of u-shaped cross-section. The brace comprises a first rivet extending through the first rail flange and first flange. The brace comprises a second rivet extending through the second rail flange and the second flange adjacent the rail end.

The present invention pertains to a method for using a ladder. The method comprises the steps of receiving a lateral force on a knee brace of a ladder. There is the step of transferring the lateral force from the knee brace to a web, the first rail flange and a second rail flange of the ladder to which the knee brace is connected through a first portion that connects to the step; and a second portion which connects to the rail and terminates at a distance from a joint. The second portion's first and second flanges and web presenting 3 contact surfaces which connect to the rail and extend essentially in parallel with the rail and conforms with the rail to which the knee brace is attached so forces can be transferred therebetween. The first and second flanges contact the first rail flange and second rail flange, respectively, and the web contacts the web of the rail of u-shaped cross-section. There is a first rivet extending through the first rail flange and first flange, and a second rivet extending through the second rail flange and the second flange adjacent the rail end. The web extending from the first flange and the second flange which together form a u-shaped cross-section.

BRIEF DESCRIPTION OF THE DRAWINGS

In the accompanying drawings, the preferred embodiment of the invention and preferred methods of practicing the invention are illustrated in which.

DETAILED DESCRIPTION

Figure 1:
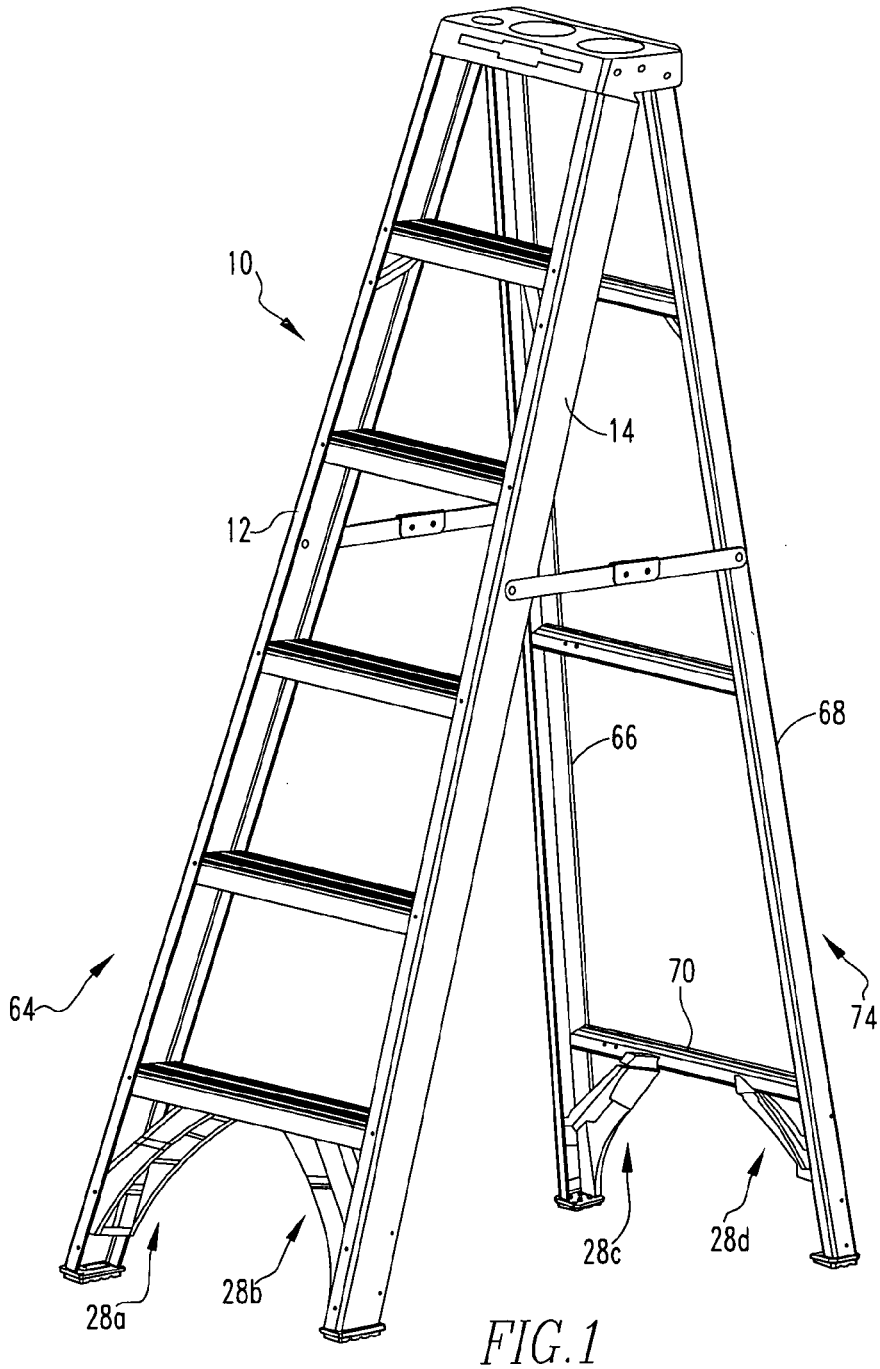
FIG. 1 is a schematic representation of a perspective view of a step ladder having a knee brace of the present invention.
Figure 2:
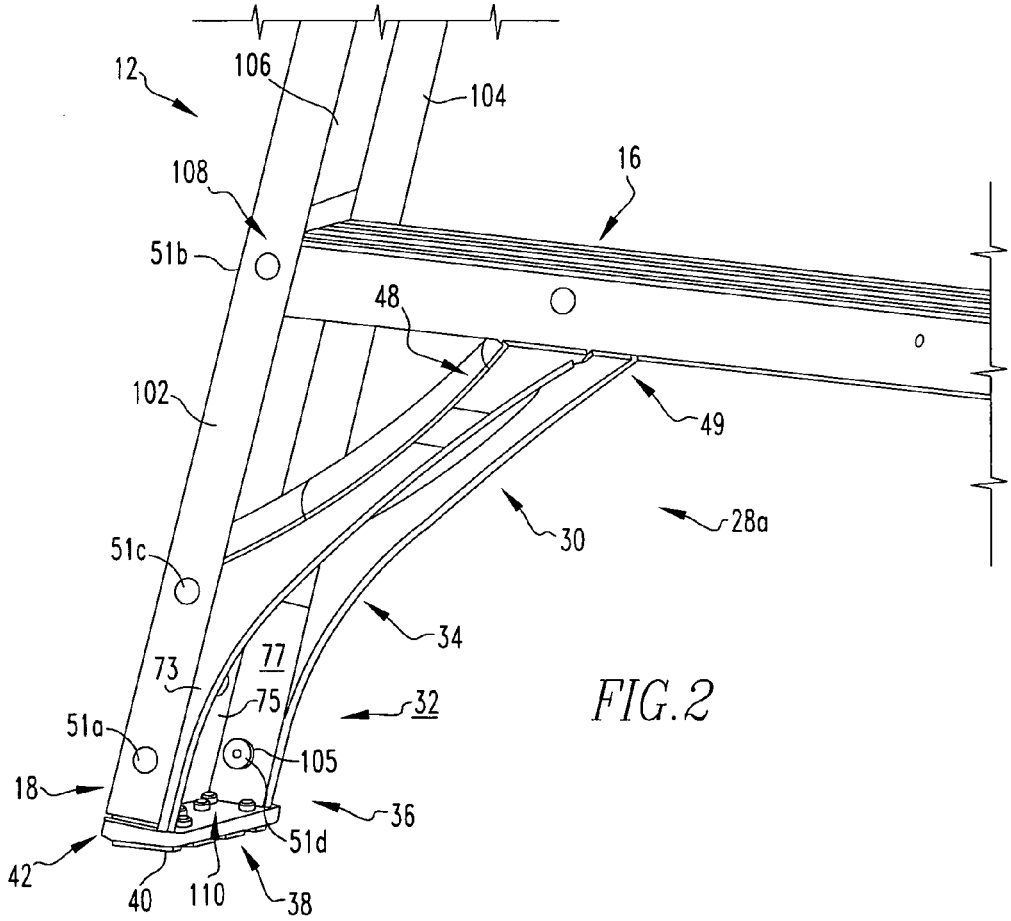
FIG. 2 is a schematic representation of a perspective view of a front knee brace connected to a rail and a step of a ladder of the present invention.

Referring now to the drawings wherein like reference numerals refer to similar or identical parts throughout the several views, and more specifically to FIGS. 1 and 2 thereof, there is shown a knee brace 28 for a ladder 10 having a rail with a first rail flange 102, second rail flange 104 and a rail web 106 disposed between the first rail flange 102 and the second rail flange 104, a step 16 connected to the rail to form a joint 108, and a rail end 18. The brace 28 comprises a first flange 73. The brace comprises a second flange 77. The brace comprises a web 75 extending from the first flange 73 and the second flange 77 which together form a u-shaped cross-section. The brace 28 comprises a first portion 30 that connects to the step 16. The brace 28 comprises a second portion 32 which connects to the rail and terminates at a distance from the joint 108. The second portion's first and second flanges and web 75 presenting three contact surfaces which connect to the rail and extend essentially in parallel with the rail and conforms with the rail to which the knee brace 28 is attached so forces can be transferred therebetween. The first and second flanges contact the first rail flange 102 and second rail flange 104, respectively, and the web 75 contacts the web 106 of the rail of u-shaped cross-section. The brace 28 comprises a first rivet 51*a* extending through the first rail flange 102 and first flange 73. The brace 28 comprises a second rivet 51*d* extending through the second rail flange 104 and the second flange 104 adjacent the rail end 18.

Preferably, the first flange 73, second flange 77 and web 75 define an interior 110 which is free of any load supporting elements regarding loads from the first or second rail flanges which extend from either the web 75 or the first flange 73 or the second flange 77 into the interior 110. Preferably, the second portion 32 has a first end 34 connected to the first portion 30 and a second end 36 including a foot 38 integrally connected to the second end 36 of the second portion 32 to form one continuous piece therewith. The foot 38 is disposed to receive the bottom of the rail 12 so weight on the rail 12*b* is transferred to the foot 38 or the second portion 32. The first portion 30, second portion 32 and foot 38 are preferably one continuous piece of plastic. The knee brace 28 preferably includes a washer 105 which is imbedded in the first flange 73 and which cannot be removed without tearing the first flange 73. The first rivet 51*a* extends through the washer 105.

The present invention pertains to a method for using a ladder. The method comprises the steps of receiving a lateral force on a knee brace 28 of a ladder 10. There is the step of transferring the lateral force from the knee brace 28 to a web 106, a first rail flange 102 and a second rail flange 104 of the ladder 10 to which the knee brace 28 is connected through a first flange 73, a second flange 77 and a web 75 extending from the first flange 73 and the second flange 77 which together form a u-shaped cross-section. The brace 28 comprises a first portion 30 that connects to the step 16. The brace 28 comprises a second portion 32 which connects to the rail and terminates at a distance from the joint 108. The second portion's first and second flanges and web 75 presenting three contact surfaces which connect to the rail and extend essentially in parallel with the rail and conforms with the rail to which the knee brace 28 is attached so forces can be transferred therebetween. The first and second flanges contact the first rail flange 102 and second rail flange 104, respectively, and the web 75 contacts the web 106 of the rail of u-shaped cross-section. The brace 28 comprises a first rivet 51*a* extending through the first rail flange 102 and first flange 73. The brace 28 comprises a second rivet 51*d* extending through the second rail flange 104 and the second flange 104 adjacent the rail end 18. The web 75 extending from the first flange 73 and the second flange 77 which together form a u-shaped cross-section.

In the operation of the preferred embodiment, a ladder 10, as shown in FIGS. 1-7, has a front section 64 comprised of a first side rail 12, a second side rail 14, at least a first step 16, a first front member 28*a* and a second front member 28*b* connecting the first step 16 to the first side rail 12 and second side rail 14, respectively. The first front member 28*a* and second front member 28*b* each have a first portion 30 and a second portion 32. The first portion 30 is connected to the first step 16 of the ladder 10 at a flange portion 48 at a first end 49 of the first portion 30. The second portion 32 of the first front member 28*a* is connected to the first side rail 12, and the second portion 32 of the second front member 28*b* is connected to the side rail 14 of the ladder 10. The second portion 32 is also integrally connected to the first portion 30 at the first end 34 of the second portion 32 and to a foot 38 at a second end 36 of the second portion 32.

Figure 3:
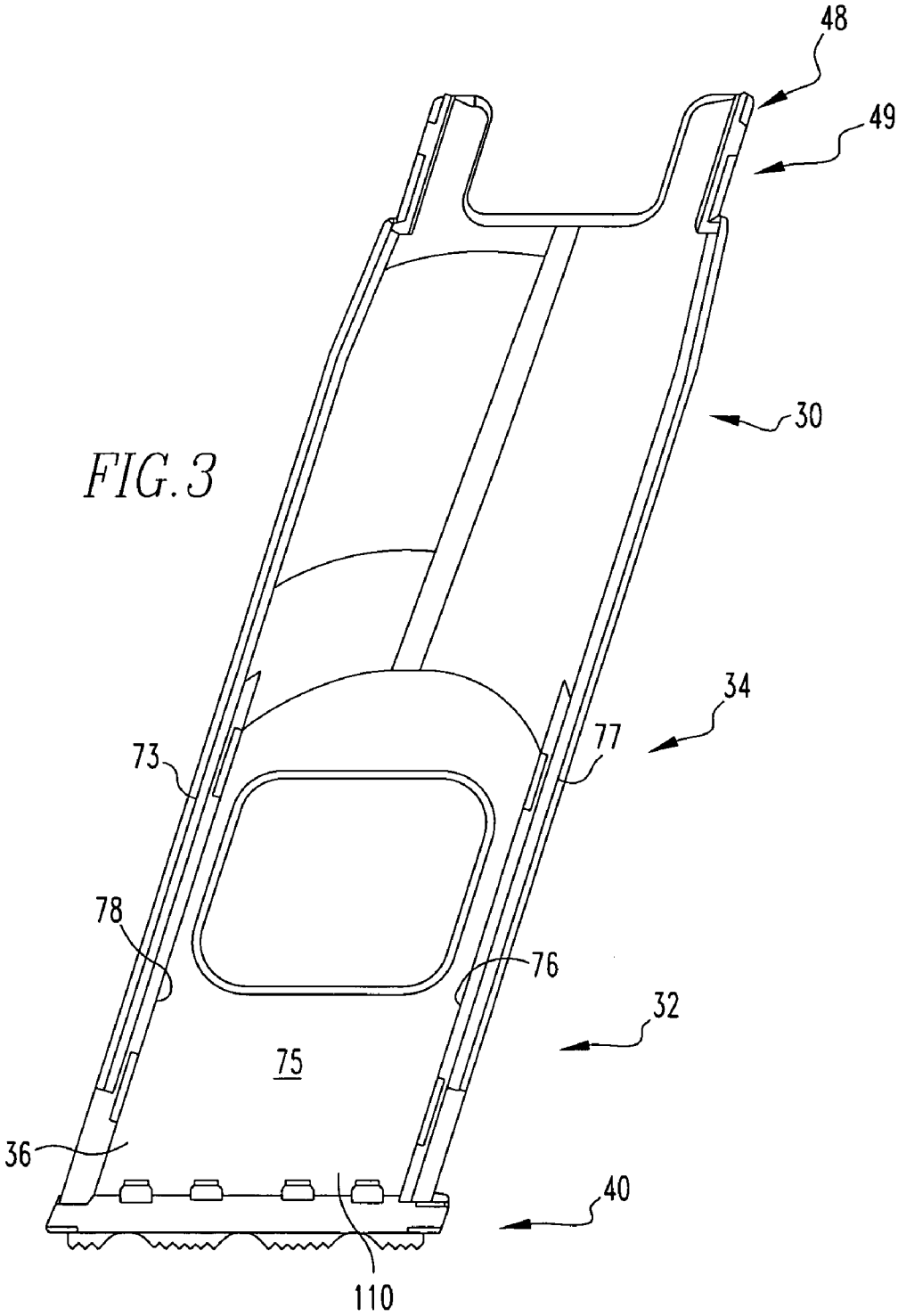
FIG. 3 is a schematic representation of a right view of the knee brace.
Figure 4:
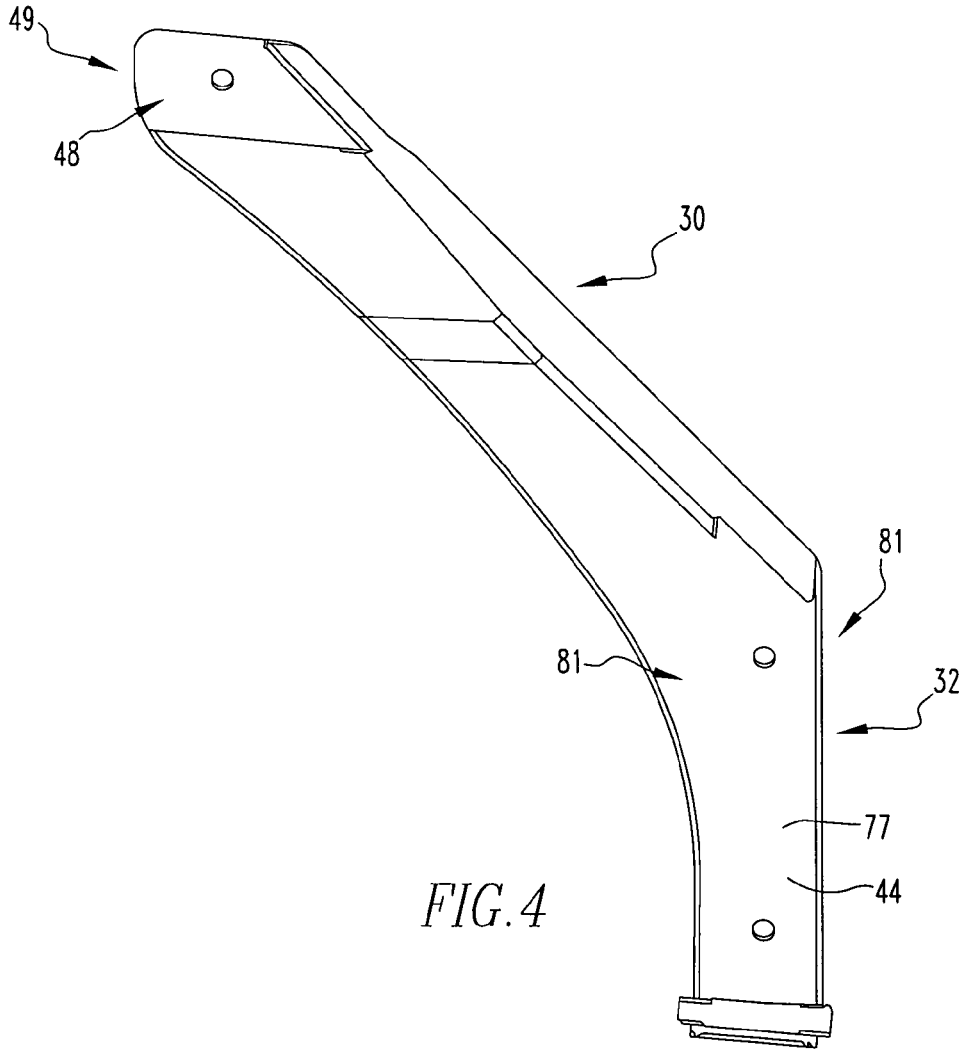
FIG. 4 is a schematic representation of a back view of the knee brace.
Figure 5:
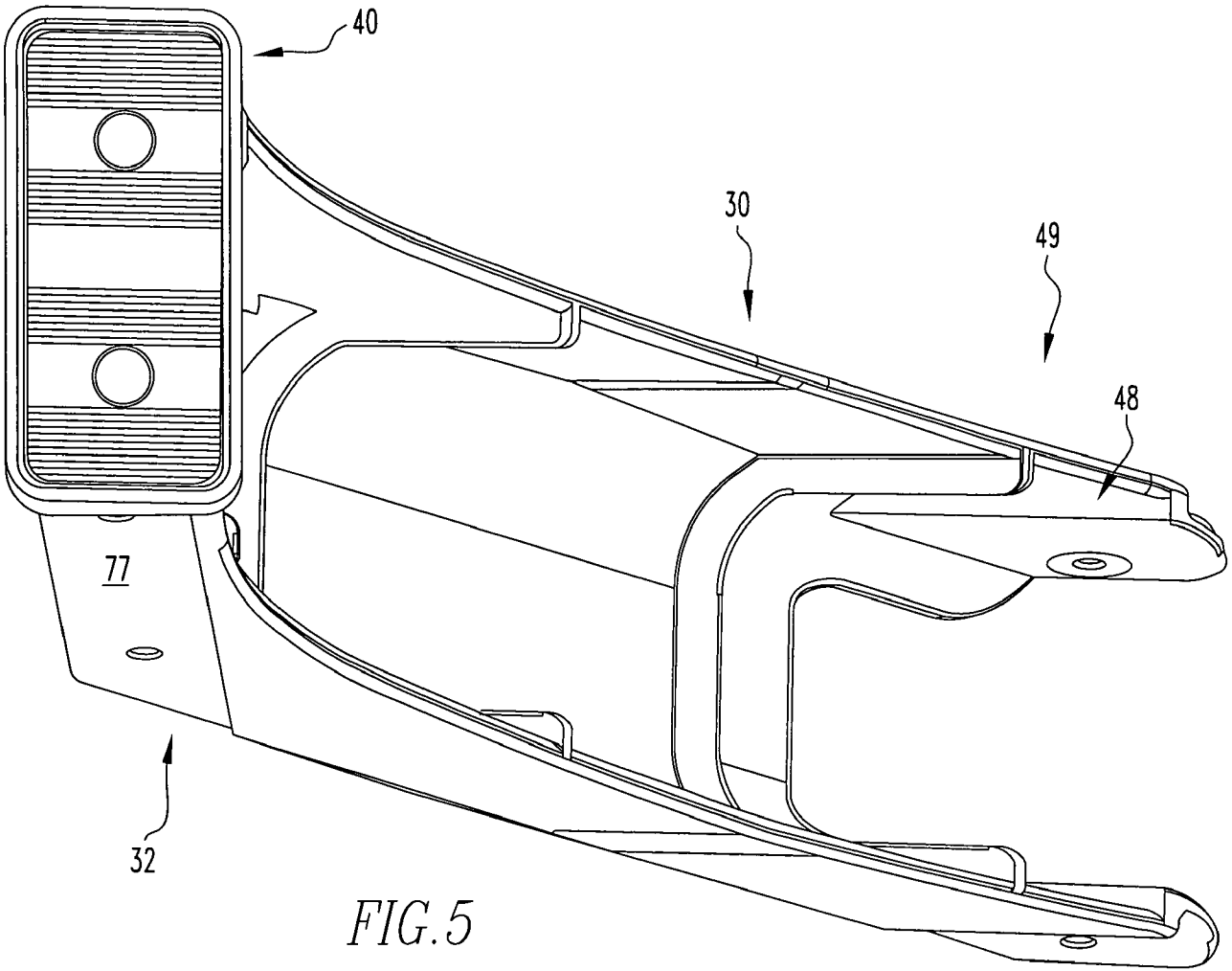
FIG. 5 is a schematic representation of a bottom view of the knee brace.
Figure 6:
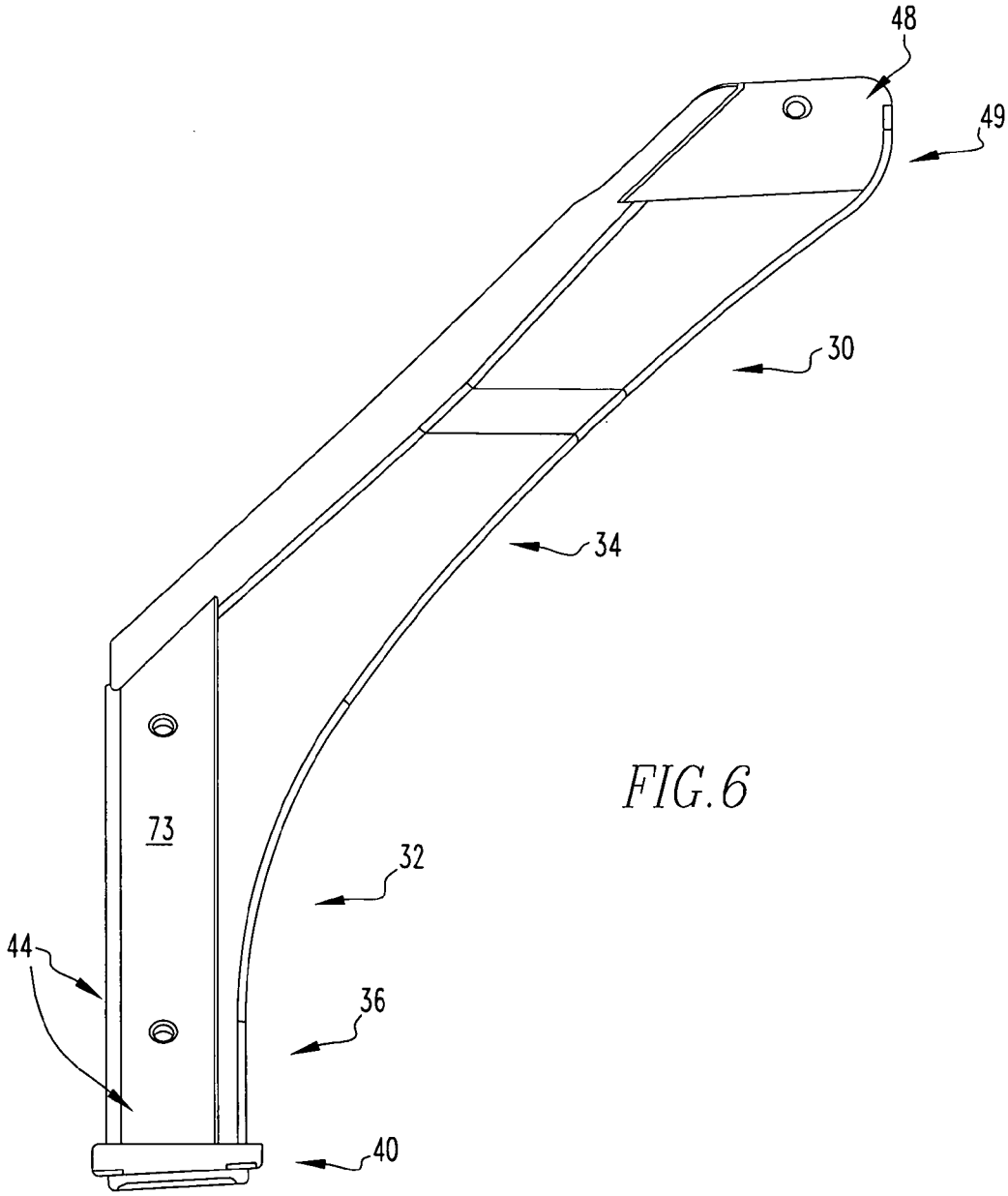
FIG. 6 is a schematic representation of a front view of the knee brace.
Figure 7:
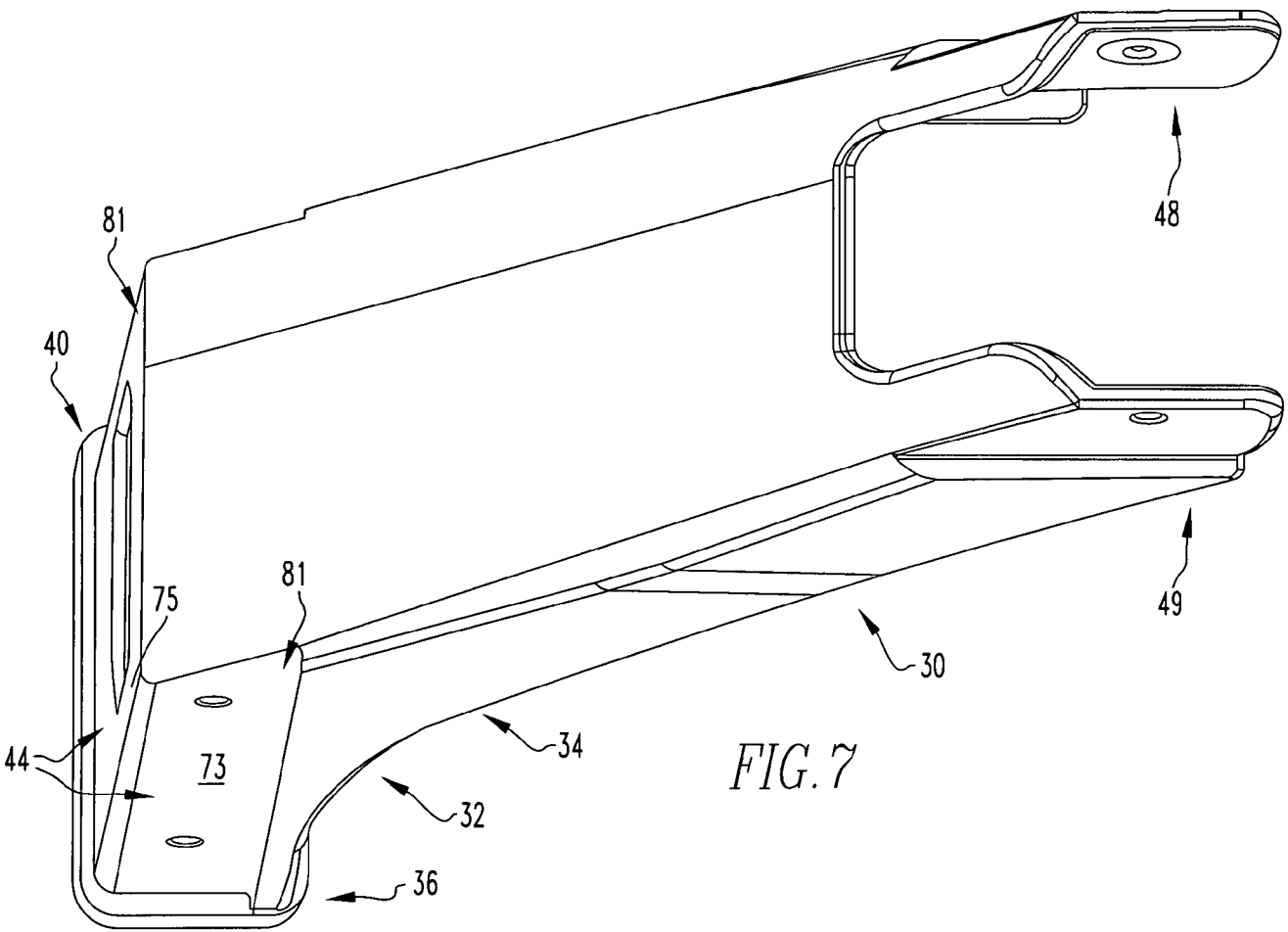
FIG. 7 is a schematic representation of a top view of the knee brace.
Figure 8:
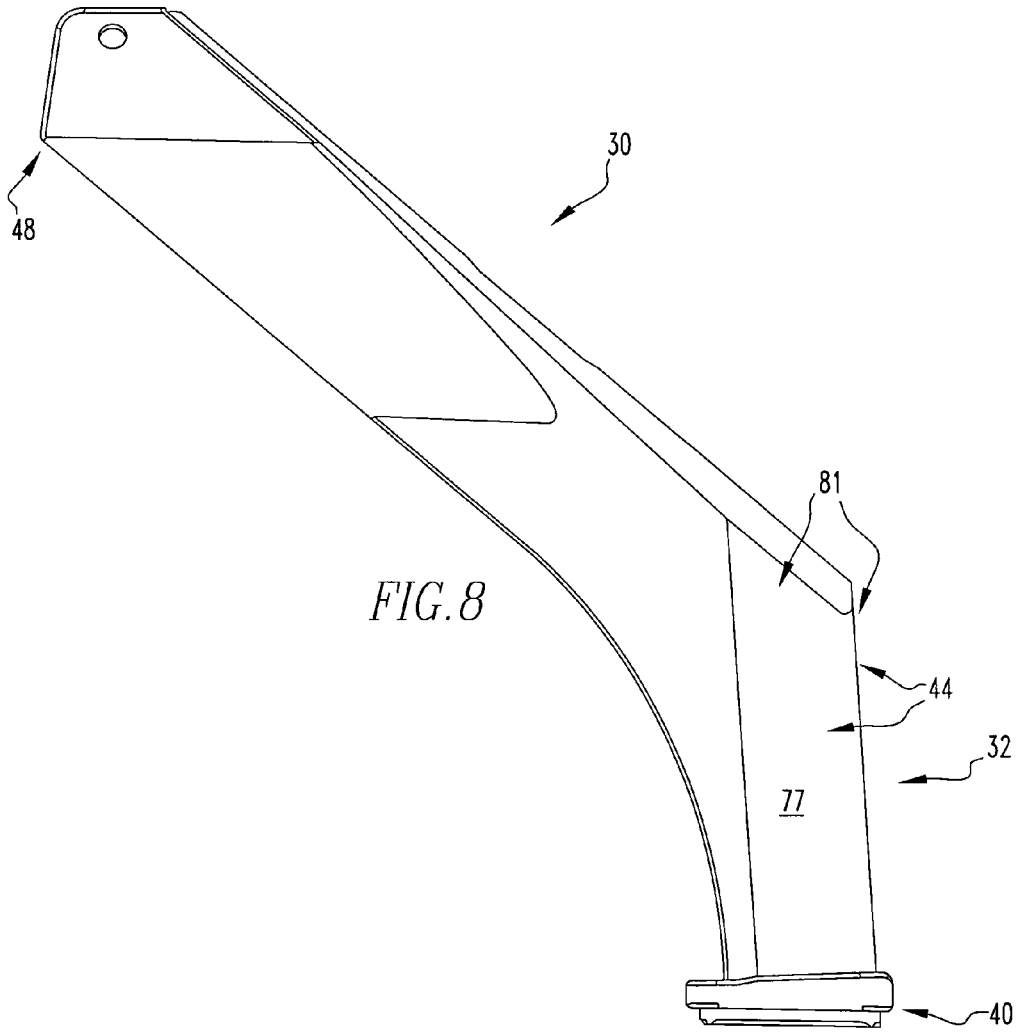
FIG. 8 is a schematic representation of a back view of a rear knee brace.
Figure 9:
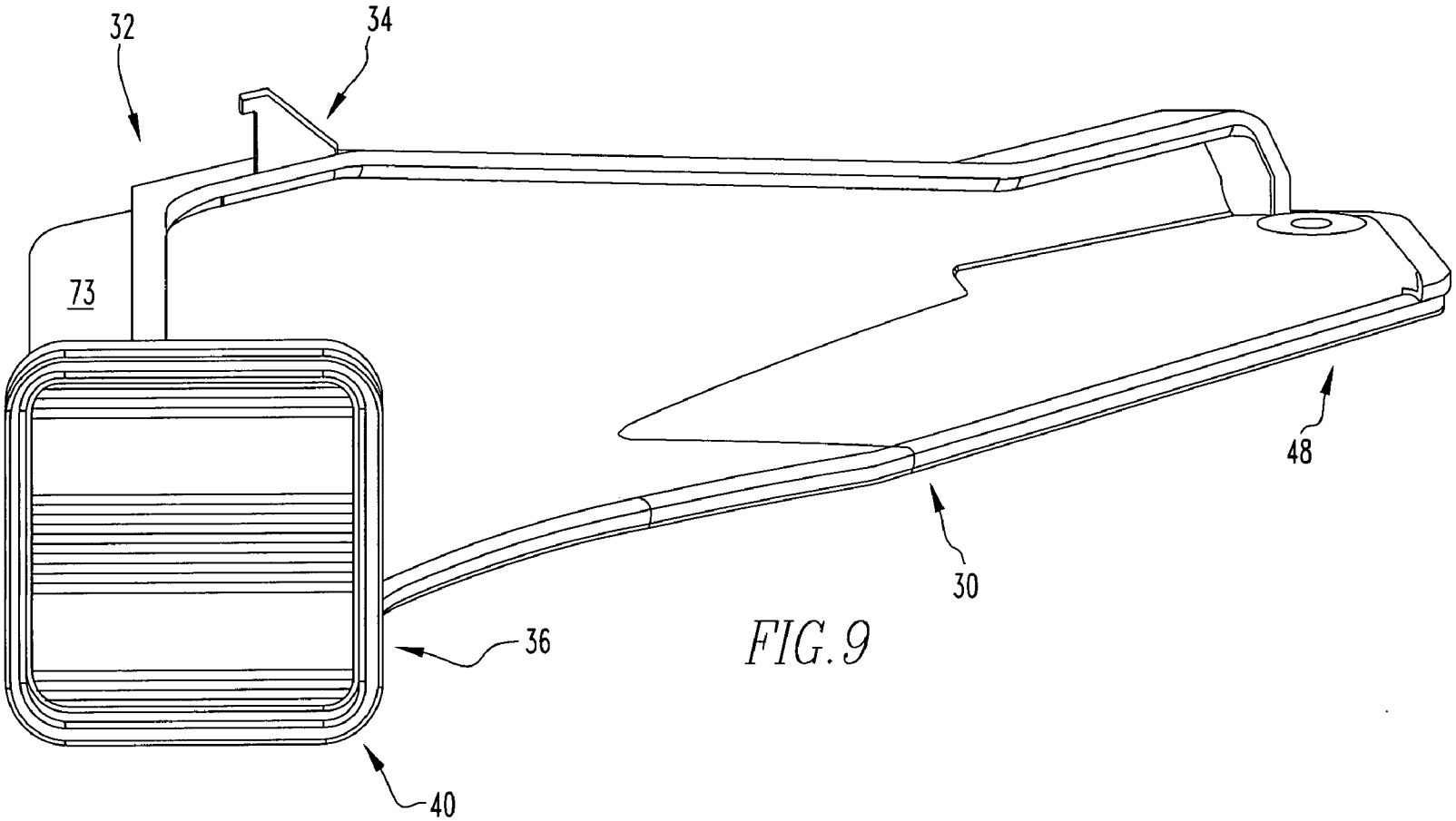
FIG. 9 is a schematic representation of a bottom view of the rear knee brace.
Figure 10:
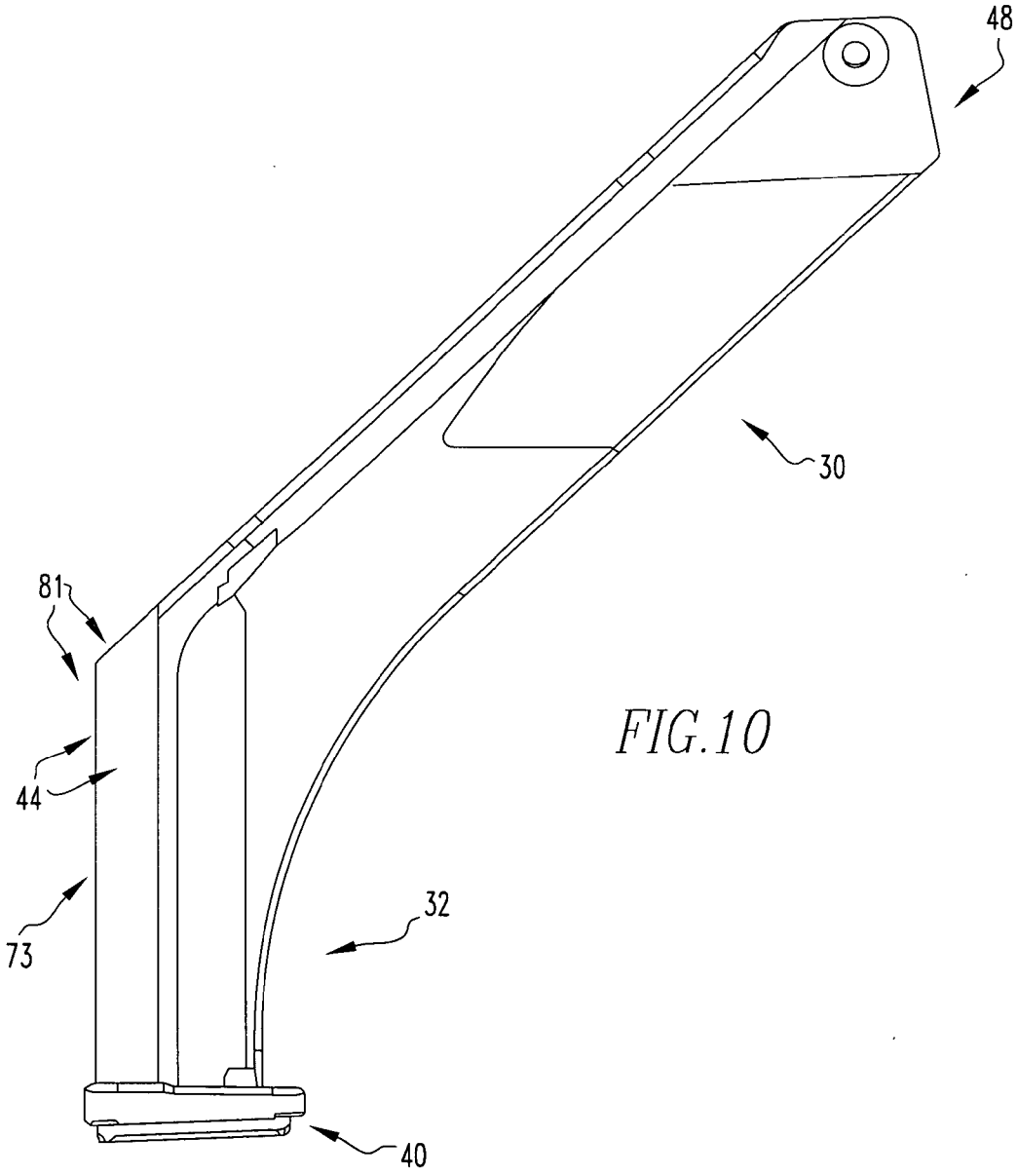
FIG. 10 is a schematic representation of a front view of the rear knee brace.
Figure 11:
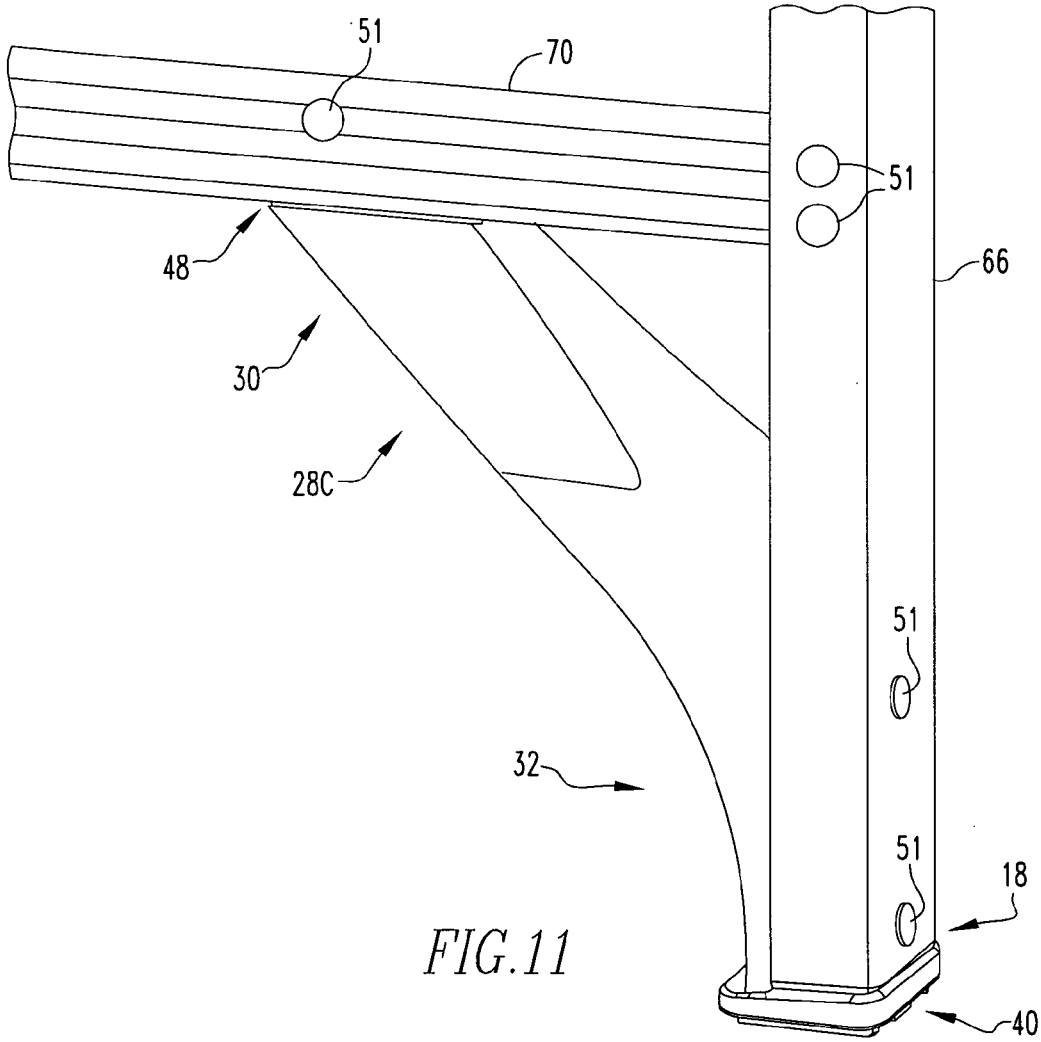
FIG. 11 is a schematic representation of a perspective view of the rear knee brace.
Figure 12:
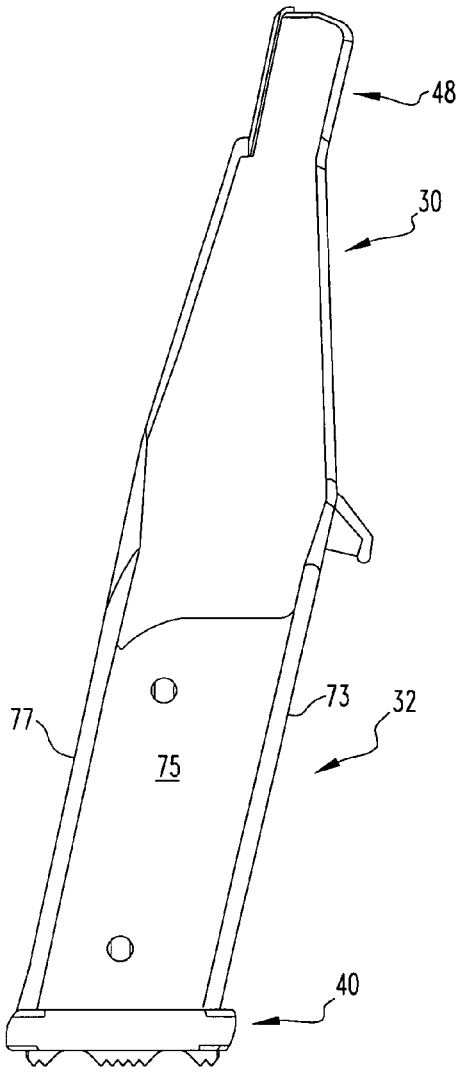
FIG. 12 is a schematic representation of a left view of the rear knee brace.
Figure 13:
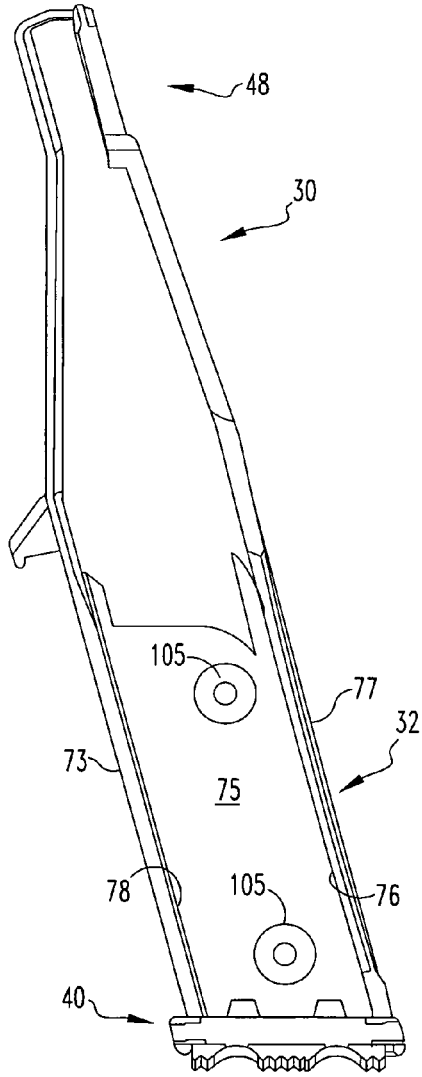
FIG. 13 is a schematic representation of a right view of the rear knee brace.
Figure 14:
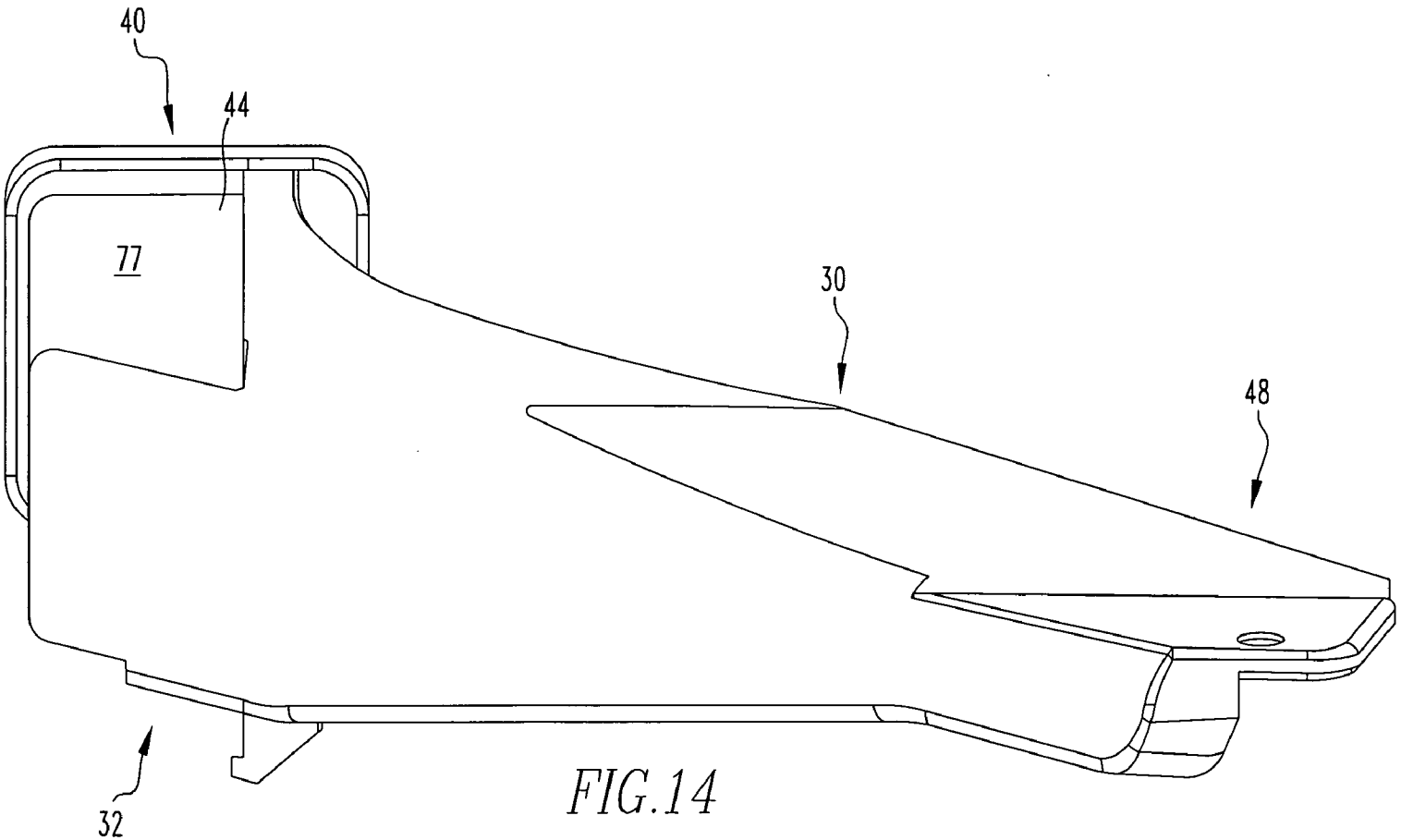
FIG. 14 is a schematic representation of a top view of the rear knee brace.

The second portion 32 has a channel 81 with a contact surface 44 defined by its first flange 73, web 75 to which the first flange is integrally connected, second flange 77 to which the web 75 is integrally connected at the end 76 opposite the end 78 the first flange 73 is connected to the web 75 and the second flange 77, as shown in FIG. 3. In the channel 81, the respective rail fits with and conforms with the contact surface 44 which extends from the first end 34 of the second portion to the foot 38 that is integrally connected to the second portion 32 at the second portion's second end 36. The respective rail rests against the foot 38 during normal operation. On the foot bottom 42 is a foot pad 40 for gripping the ground when the ladder is in use. The first portion 30 and second portion 32 of each front member 28*a*, 28*b* has no cross plates or type of buttressing. The first flange 73, web 75 and second flange 77 are strong enough themselves that so they do not collapse or fold in when loads they are rated for are placed on them without any buttressing.

By the first front member 28*a* and second front member 28*b* being comprised of one continuous piece of plastic, it saves time in assembly since only one piece has to be connected to the respective rail and step 16. The presence of the second portion 32 having the contact surface 44 extending from its first end 34 to the foot 38 also provides additional support in regard to forces on the ladder 10 than would otherwise be present if a traditional knee brace only was present connecting the respective rail to the step 16. Forces which are transmitted to the first portion 30 from the rail are in turn transmitted to the second portion and consequently distributed throughout the contact surface 44. Since the contact surface 44 is in contact with the rail, the force being transmitted through the contact surface 44 causes the contact surface 44 to push against the rail. The force is thus transmitted to the rail over essentially the entire contact surface 44 which effectively dissipates the force because it is no longer concentrated at any one localized area. This can be seen, for instance, when a cantilever force is applied to the second portion 32. The force is distributed through the contact surface 44, causing the first flange 73, web 75 and second flange 77 to transmit the forces along their length to the rail rather than being focused essentially at the point where the rivet 51 contacts the respective rail. For instance, a horizontal force arising from a user placing his foot in a somewhat horizontal direction relative to the ground onto the corner of the step 16 has the force thereon transferred to the step 16 on which the foot is placed. In turn, this force is transmitted to the rail 12 through the rivet 51*b*, as shown in FIG. 1, that connects the step 16 to the rail 12. Additionally, force on the step 16 is transferred by the first portion 30 connected with the step 16 to the second portion 32 which is connected also to the rail 12 through rivets 51 which extend through the first and second flanges and the first and second rail flanges, respectively, and along the contact surface 44. This force is applied to the rail 12 through the first flange 73 and web 75 which push against the rail 12. Since this force is in the form of a twisting force, the second flange 77 also pushes against the inside portion of the rail 12 to which it contacts. This is because the second flange 77 also experiences the twisting force which tends to attempt to drive it out and away from the rail. However, due to the fact that it conforms with the rail, it instead transfers the force to the rail, rather than twisting out of the rail. In short, due to the length of the second portion 32, a force is dissipated by being distributed over a larger surf-ace area than if there was only a rivet 51 connecting the first portion 30 from the step 16 to the rail 12.

Similarly, a cantilever force applied to the bottom 18 of the first side rail is distributed to the contact surface 44, through the first portion 30 to the step 16. The presence of the second portion 32 extending along the rail through its contact surface 44 thus dissipates the force that would otherwise be mostly absorbed by the rail or concentrated at a rivet 51 if there was no second portion 32 present. Essentially, this same explanation of dissipation of forces is present whether the force arises from a user placing his foot on the first step 16 or a second step 22 that is higher off of the ground, whether the force arises from a user shifting his weight while standing off-center on a step or an external cantilever force is applied to the rail during transportation, such as when it is put in or taken out of a truck, or dropped.

In regard to the first rear brace 28*c* and second rear brace 28*d,* as shown in FIGS. 8-14, they are connected to the third rail 66 and fourth rail 68, respectively, and to the first horizontal 70 of the rear section 74 of the stepladder 10. Each rear brace has a contact surface 44 and a channel 81 as described above in regard to the front braces. The important difference, however, is that the first flange 73 of the rear brace is shorter than the second flange 77 of the rear brace due to the fact that the side rails of the rear section 74 are of essentially this same cross sectional configuration and require the same configuration of the rear braces 28*c,* 28*d* so they can conform with and contact the rear side rails.

The first portion 30 has a first flange 73 connected to a web 75, and a second arm 77 also connected to the web 75 at its end 76 opposite the end 78 the first arm 73 is connected to the web 75. The first flange 73 and the second flange 77 in the first portion 30 extends only a small distance relative to the first flange 73 of the second portion 32 to minimize weight in regard to the loads it is required to withstand. The first portion extends at an angle of 42° from the second portion 32. The first portion 30 of each rear knee brace is connected to the first horizontal 70 through its flange 48 that extends from the second flange 77 of the rear knee brace.

When a cantilever force is applied to the bottom 18 of a rail on the rear section 74, the force is distributed from the rail to the contact surface 44 of the second portion 32. The first flange 73, the web 75 and the second flange 77 which define the contact surface 44 of the second portion 32 transfers forces either from the rail or to the rail in which they are in contact depending on the direction from where the force arises. Such force is dissipated by it being spread out over the contact surface 44 as opposed to it being localized at a rivet 51 of a normal shaped knee brace that extends essentially only from the rivet 51 on a rail to a horizontal. The forces transmitted to the contact surface 44 from the rail are in turn transferred to the web 75, the first flange 73 and the second flange 77 of the first portion 30. The flange 48 connected to the second flange 77 and web 75 in turn transfers this force to the first horizontal 70. A twisting force transferred through the first portion does not cause the first portion 30 to fail because the first flange, web and second flange relationship are strong enough because of their material and dimensions to better resist twisting or bending forces, but again with minimum weight. When forces are transmitted through the rear brace from the first horizontal 70 to the respective rail, reaction of the rear brace is the same except in reverse order. The presence of the second portion 32 allows the force from the horizontal 70 to be diffused along the rail from the contact surface 44 instead of just in the localized area about the rivet hole 83 where the first horizontal 70 is attached to the respective rail or the rivet 51, as described above in regard to the front braces with the rails on the front section 64. It should be noted, with respect to the rear braces, the rivets 51 extend through the web 75; otherwise, the rear brace will tear away from the rear rail under loads for which it is rated.

The washers 105 for the rivets are insert molded. The way this process works is that there is a loading station that sorts the washers and positions them correctly to be handled by end of arm tooling. A robot positions the end of arm tooling to a loading station and takes possession of the washers 105. The robot positions the end of arm tooling above a press until a mold opens. Once the mold opens, the robot lowers, removes the parts from the mold, then places the washers on the core pins that form the holes of the combination knee brace. Once the washers 105 are placed, the robot exits the molding area, places the parts on a table, and returns to the loading station to pick up the next load of washers. Concurrently, the mold closes and the plastic is injected into the cavities of the mold forming around the washers 105, thus maintaining them in the proper position. When the molding cycle is complete, the mold opens and the parts are again removed by the robot and the next set of washers 105 are placed on the core pins.

Figure 15:
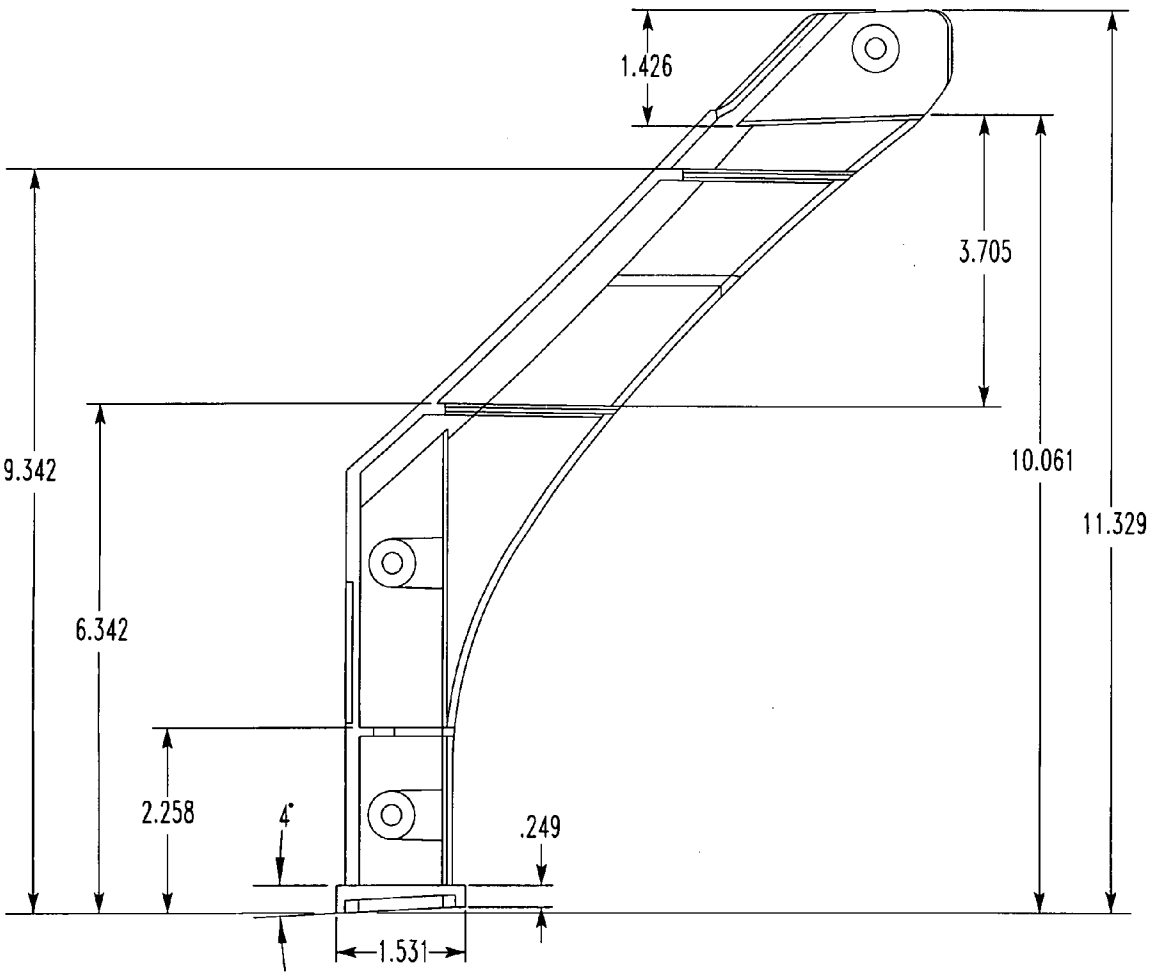
FIG. 15 is a schematic representation of a front view of the knee brace with preferred dimensions.
Figure 17:
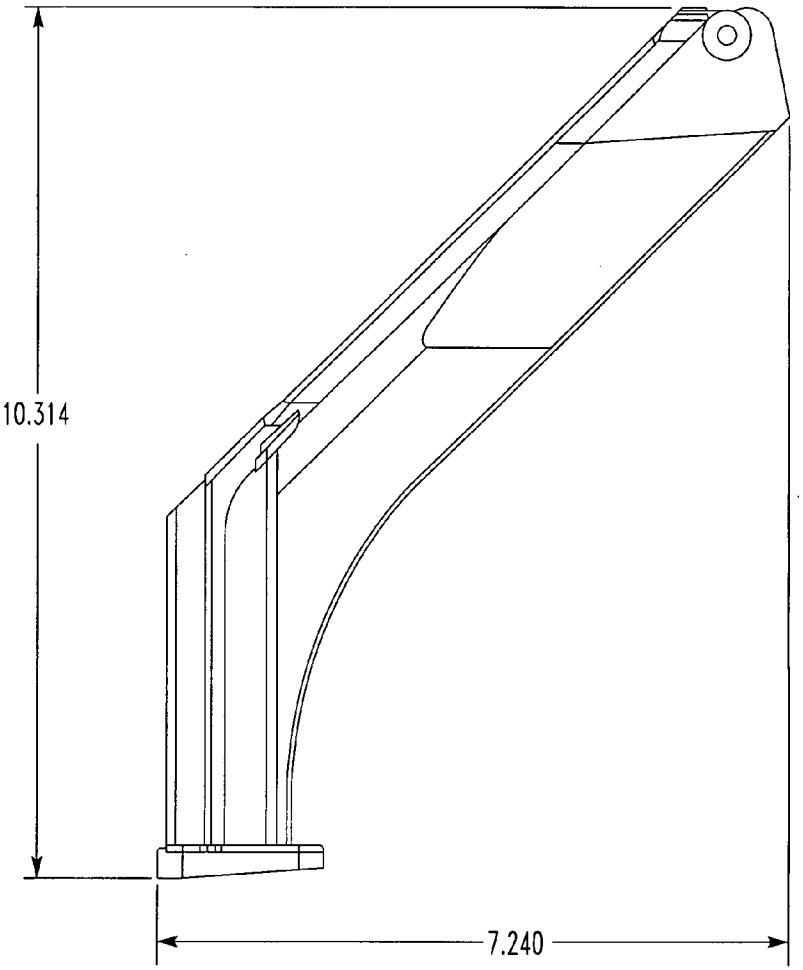
FIG. 17 is a schematic representation of a front view of the rear knee brace with preferred dimensions.
Figure 16:
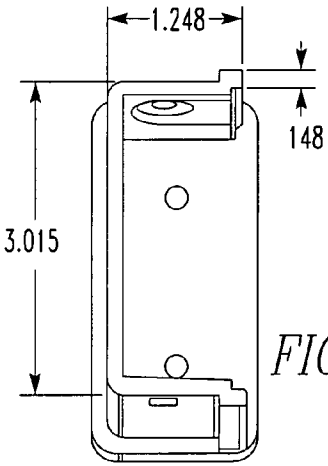
FIG. 16 is a schematic representation of a perspective top view of the knee brace with preferred dimensions.
Figure 18:
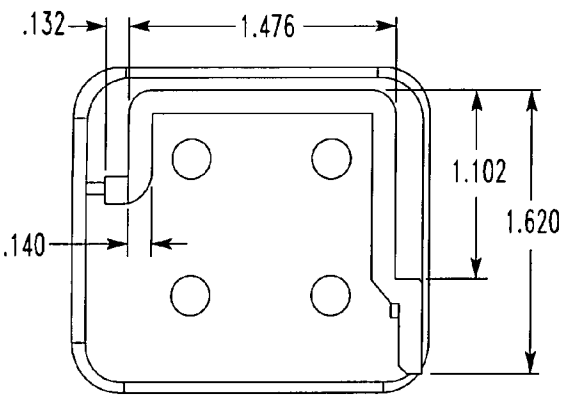
FIG. 18 is a schematic representation of a top view of the knee brace with preferred dimensions.

FIGS. 15 and 16 show the dimensions regarding a preferred embodiment of the front knee brace. FIGS. 17 and 18 show dimensions regarding a preferred embodiment of the rear knee brace.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A knee brace for a ladder having a rail with a first rail flange, second rail flange and a rail web disposed between the first rail flange and the second rail flange, a step connected to the rail to form a joint, and a rail end comprising:

a first flange;

a second flange;

a web extending from the first flange and the second flange which together form a u-shaped cross-section and comprising:

a first portion that connects to the step;

a second portion which connects to the rail and terminates at a distance from the joint, the second portion's first and second flanges and web presenting 3 contact surfaces which connect to the rail and extend essentially in parallel with the rail and conforms with the rail to which the knee brace is attached so forces can be transferred therebetween, the first and second flanges contact the first rail flange and second rail flange, respectively, and the web contacts the web of the rail of u-shaped cross-section, and a first rivet extending through the first rail flange and first flange, and a second rivet extending through the second rail flange and the second flange adjacent the rail end, the first flange, second flange and web define an interior which is free of any load supporting elements regarding loads for the first or second rail flanges which extend from either the web or the first flange or the second flange into the interior; and a foot extending from the web, first portion and second portion upon which the rail end is situated; the web, the first and second portions and foot one continuous piece made of plastic.

2. A knee brace as described in claim 1 wherein the second portion has a first end connected to the first portion and a second end including a foot integrally connected to the second end of the second portion to form one continuous piece therewith, said foot disposed to receive the bottom of the rail so weight on the rail is transferred to the foot or the second portion.

3. A knee brace as described in claim 2 wherein the first portion, second portion and foot are one continuous piece of plastic.

4. A knee brace as described in claim 3 including a washer which is imbedded in the first flange and which cannot be removed without tearing the first flange, the first rivet extending through the washer.

5. A method for using a ladder comprising the steps of:

receiving a lateral force on a knee brace of a ladder; and transferring the lateral force from the knee brace to a web, the first rail flange and a second rail flange of the ladder to which the knee brace is connected through a first portion that connects to the step; and a second portion which connects to the rail and terminates at a distance from a joint, the second portion's first and second flanges and web presenting 3 contact surfaces which connect to the rail and extend essentially in parallel with the rail and conforms with the rail to which the knee brace is attached so forces can be transferred therebetween, the first and second flanges contact the first rail flange and second rail flange, respectively, and the web contacts the web of the rail of u-shaped cross-section, and a first rivet extending through the first rail flange and first flange, and a second rivet extending through the second rail flange and the second flange adjacent the rail end, the web extending from the first flange and the second flange which together form a u-shaped cross-section, the first flange, second flange and web define an interior which is free of any load supporting elements regarding loads for the first or second rail flanges which extend from either the web or the first flange or the second flange into the interior, and a foot extending from the web, first portion and second portion upon which the rail end is situated; the web, the first and second portions and foot one continuous piece made of plastic.

* * * * *